US006500038B1

(12) United States Patent
Jaeger et al.

(10) Patent No.: US 6,500,038 B1
(45) Date of Patent: Dec. 31, 2002

(54) PASSIVE AIR VENT SYSTEM FOR A MARINE PROPULSION ENGINE

(75) Inventors: Matthew W. Jaeger, Stillwater, OK (US); Thomas W. Boyer, Collinsville, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/035,934

(22) Filed: Oct. 29, 2001

(51) Int. Cl.[7] ..... B63H 21/38
(52) U.S. Cl. ..... 440/88; 123/41.08; 427/244
(58) Field of Search ..... 440/88; 123/41.14, 123/41.08, 41.31; 205/637; 427/244

(56) References Cited

U.S. PATENT DOCUMENTS

| | | | | | |
|---|---|---|---|---|---|
| 4,133,284 | A | * | 1/1979 | Holcroft | 440/88 |
| 4,214,443 | A | * | 7/1980 | Herenius | 123/41.48 |
| 4,991,546 | A | * | 2/1991 | Yoshimura | 123/41.09 |
| 5,329,888 | A | | 7/1994 | Luckett et al. | 123/41 |
| 5,342,434 | A | * | 8/1994 | Wu | 96/13 |
| 5,554,414 | A | * | 9/1996 | Moya et al. | 427/244 |
| 5,658,449 | A | * | 8/1997 | Benz et al. | 204/252 |
| 5,677,031 | A | * | 10/1997 | Allan et al. | 428/137 |
| 5,888,399 | A | * | 3/1999 | Rutledge et al. | 210/634 |
| 6,040,251 | A | | 3/2000 | Caldwell | 442/123 |
| 6,089,934 | A | | 7/2000 | Biggs et al. | 440/88 |
| 6,123,751 | A | * | 9/2000 | Nelson et al. | 55/302 |
| 6,135,064 | A | | 10/2000 | Logan et al. | 123/41 |
| 6,196,708 | B1 | * | 3/2001 | Rogers | 427/244 |
| 6,331,127 | B1 | * | 12/2001 | Suzuki | 440/88 |

OTHER PUBLICATIONS

Product Information Sheet from Internet—PreVent enclosure Vents.
Product Information Sheet from Internet—W.L. Gore.
Product Information Sheet from Internet—Defining Terms—Filter Media Properties.

* cited by examiner

*Primary Examiner*—S. Joseph Morano
*Assistant Examiner*—Lars A. Olson
(74) *Attorney, Agent, or Firm*—William D. Lanyi

(57) ABSTRACT

A marine propulsion system is provided with a hydrophobic membrane disposed across a port of its cooling system which allows air to pass through the membrane, but inhibits water from passing through it. During draining procedures, air can freely pass into the cooling system through the membrane to replace evacuated water and avoid the formation of low pressure regions within the cooling system. During initiation of the marine propulsion engine, following a period when what has been drained from the cooling system, air can freely pass through the membrane to be expelled from the cooling system as it is replaced by water pumped in the cooling system by a sea pump.

18 Claims, 3 Drawing Sheets

PASSIVE AIR VENT SYSTEM FOR A MARINE PROPULSION ENGINE

BACKGROUND OF THE INVENTION

1. Field of the Invention

The present invention is generally related to a passive air venting system used in a marine propulsion system and, more particularly, to a passive air vent using a hydrophobic or oleophobic membrane.

2. Description of the Prior Art

When marine engines are drained, or restarted after a period during which coolant has drained from the engine, it is necessary that the exchange of air and water be accomplished in a timely and efficient manner. When a marine propulsion system is in the process of evacuating its cooling water, it is important that steps be taken to avoid forming pockets of air in the cooling system which are subjected to decreasing pressure because of the sudden evacuation of water. In addition, when initially filling the cooling passages of a marine engine after water has been drained, it is important to evacuate the air from the system in an efficient manner to avoid "vapor lock" conditions that can inhibit the proper filling of the cooling passages with water.

U.S. Pat. No. 6,135,064, which issued to Logan et al on Oct. 24, 2000, discloses an engine drain system. The engine cooling system of a marine propulsion device is provided with a manifold that is located below the lowest point of the cooling system of an engine. The manifold is connected to the cooling system of the engine, a water pump, a circulation, the exhaust manifold of the engine, and a drain conduit through which all of the water can be drained from the engine.

U.S. Pat. No. 6,089,934, which issued to Biggs et al on Jul. 18, 2000, discloses an engine cooling system with a simplified drain and flushing procedure. The engine cooling system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is in turn attached to a handle. By manipulating the handle, the tether forces the retainer to slide along the flexible conduit and control the position of the second ends of the flexible conduits. This allows the system to be moved from a first position with the second ends of the conduits above the first ends of the conduits to a second position with the second ends of the conduits below the first ends and in the bilge of the boat. The system allows an operator to stand in a single location and move the drain system from the first to the second position and back again without having to reach down into the engine compartment to remove drain plugs. The system allows the cooling system to be easily drained or flushed.

U.S. patent application Ser. No. 09/887,823, which was filed Casey et al on Jun. 22, 2001, discloses a pump and drain apparatus for a marine propulsion system. An integral pump and drain apparatus is contained in a common housing structure to reduce the required space for these components in the vicinity proximate the engine of a marine propulsion system. The valve of the drain is remotely actuated by air pressure and therefore does not require the boat operator to manually remove plugs or manually actuate mechanical components to cause the engine to drain through a drain conduit that is formed as an integral part of the housing structure. U.S. patent application Ser. No. 09/891,121 which was filed by Jaeger on Jun. 25, 2001, discloses a siphon inhibiting device for a marine cooling system. The siphon inhibiting valve comprises first and second portions of a housing structure and a buoyant member disposed within the housing structure for movement along a first axis between an inlet port and an outlet port. The buoyant member is shaped to have a cylindrical portion and another portion which is shaped in the form of a frustum of a cone. Upward movement of the buoyant member causes an elastomeric seal on the buoyant member to come into contact with an internal lip formed in the housing structure, thereby creating a seal that prevents an upward flow of water in a direction from the outlet port to the inlet port. When cooling water is drained from the outlet port area, the buoyant member is forced downward into an open position by its own weight and the weight of the water on its inlet port side. This free movement of the buoyant member allows the water on the inlet port side to drain without manual intervention. When normal flow occurs, in a direction from an inlet port to the outlet port, the buoyant member is forced downward into an open position and water flows around the buoyant member from a water pump toward the cooling system of the engine. U.S. patent application Ser. No. 09/716,533 which was filed on Nov. 20, 2000, by Biggs et al discloses a marine engine cooling system with a check valve to facilitate draining. A marine engine cooling system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock the drain passage and allow water to drain from the head generating component of the marine engine. U.S. patent application Ser. No. 09/797,142 which was filed by Hughes et al on Mar. 1, 2001, discloses a marine engine cooling system with a simplified water drain and flushing mechanism. The draining system for a marine propulsion system is provided in which a manifold is located at a low portion of the cooling system to allow all of the water within the cooling system to drain through a common location or manifold. A rigid shaft is connected to a valve associated with the manifold and extending upwardly from the manifold to a location proximate the upper portion of the engine so that a marine vessel operator can easily reach the upper end of the shaft and manipulate the shaft to open the valve of the manifold. In this way, the valve can be opened to allow all of the water to drain from the engine without requiring the marine vessel operator to reach toward locations at the bottom portion of the engine.

U.S. Pat. No. 6,196,708, which issued to Rogers on Mar. 6, 2001, describes oleophobic laminated articles, assemblies of use, and methods. An article, such as a filter or film, has a treated laminate with an expanded PTFE membrane and a porous support scrim. The treated laminate is formed by contacting a laminate having an expanded PTFE membrane and a porous support scrim with an oleophobic treatment agent dissolved in an organic solvent. The oleophobic treatment agent is deposited onto the expanded PTFE membrane and porous support scrim as the organic solvent is removed. The oleophobic treatment agent is typically a fluoropolymer. The article can be used, for example, as a filter over a port in a housing of an electronics or other device.

U.S. Pat. No. 6,040,251, which issued to Caldwell on Mar. 21, 2000, describes garments of barrier webs. The invention includes a novel barrier web that has certain desirable physical characteristics such as water resistance, increased durability, improved barrier qualities and the like. The invention further comprises a barrier web comprising a web that has been treated with a curable shear thinned thixotropic polymer composition, the fabric being adapted to be substantially impermeable to liquids, permeable to gases and impermeable to microorganisms. The barrier webs of the present invention are either impermeable to all microorganisms or are impermeable to microorganisms of certain sizes. The present invention also includes fabrics that are capable of either selective binding certain microorganisms, particles or molecules depending upon what binding partners are incorporated into the polymer before application to the fabric.

U.S. Pat. No. 5,329,888, which issued to Luckett et al on Jul. 19, 1994, discloses a thermostat housing assembly for a marine engine. The assembly has a first inlet to receive sea water and an outlet that is connected to a circulating pump that circulates cooling water to the engine. A baffle is located in the housing and prevents direct flow between the sea water inlet and the outlet. The housing defines a pair of passages with a first of the passages providing communication between the sea water inlet and forms a first chamber which communicates with a pair of manifold outlets that are connected to the manifold. A second of the passages provides communication between the sea water inlet and the outlet of the circulation pump. The housing also includes a return inlet for returning water from the engine and the return inlet is connected to the second passages. A thermostat is mounted in an opening between the passages and when the thermostat is open a portion of the returning cooling water will be directed through the thermostat opening to the first passage and mixed with incoming sea water and then directed to the manifolds.

The patents described above are hereby expressly incorporated by reference in the description of the present invention.

Various types of PTFE membranes and related oleophobic products are available in commercial quantities from W. L. Gore & Associates, Inc. and are sold under various trademarks, such as GORE-TEX fabrics, PreVent membrane vents, et al. W. L. Gore & Associates, Inc. also provides various types of automobile venting products such as those sold under the trade name OLEOGARD. These devices can be used to reduce the cost and weight of components by minimizing internal pressures which will result in reduced mechanical design requirements. The vents allow rapid exchange of air in response to pressure gradients while protecting against contamination by water, automobile fluids, and dust. The Pall Corporation provides various types of filter media components with properties that are useful in producing hydrophobic or oleophobic fabrics and materials.

When marine engine draining systems formerly required extensive manual intervention, the draining process was sufficiently slow to allow air to replace water as it drained from the engine. The highly improved draining systems, such as those described above, allow water to drain from the engine at a much faster rate and this quicker draining process can, under certain conditions, create pockets of air that are subjected to decreased pressure because of the evacuation of water from lower portions of the engine's cooling system. As will be described in greater detail below, this rapid evacuation of water can possibly decrease the pressure within the cooling system sufficiently to draw water upwardly through the exhaust system of the engine and into the exhaust manifold. As is well known to those skilled in the art, water ingested into the region of the exhaust ports of the cylinders of the engine can lead to significantly deleterious results.

Also, when an engine is restarted after a period during which water has drained from its cooling passages, cooling water must be pumped from the body of water in which the marine propulsion system is operated and into the cooling passages of the engine to provide sufficient cooling capability. If air is not evacuated efficiently during this refilling operation, the condition referred to as "vapor lock" by those skilled in the art can occur and this improper filling of the cooling passages with water can lead to an overheating condition. It is therefore important that air be permitted to flow into and out of the engine cooling system at the appropriate times.

SUMMARY OF THE INVENTION

A marine propulsion system made in accordance with a preferred embodiment of the present invention comprises an engine having a cooling passage, a fluid conduit connected in fluid communication with the cooling passage, and a port formed at a preselected location of the fluid conduit. It further comprises a membrane covering the port, wherein the membrane is generally impermeable to liquid and generally permeable to gas.

The propulsion system further comprises a pump connected in fluid communication with the fluid conduit for drawing water from a body of water in which the marine propulsion system is operated and then pumping the water through the fluid conduit to the cooling passages of the engine. The fluid conduit can comprise a thermostat housing and the port can be formed in the thermostat housing. The thermostat housing is generally attached to a top portion of the engine and the port is located proximate a highest port of the fluid conduit in a particularly preferred embodiment of the present invention. The port is generally located proximate a point which is above the cooling passages of the engine in order to allow it perform its function more efficiently. The membrane covering the port is hydrophobic and, in certain embodiments, can also be oleophobic. The cooling passage of the engine comprises a cavity formed in a block of the engine to provide a path for cooling water to pass in thermal communication with heat producing components of the engine. The cooling passages within the engine are typically formed as cavities that are cast in the engine block when it is formed. These cavities are positioned so that water passing through them can efficiently remove heat from the heat producing portions of the engine.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
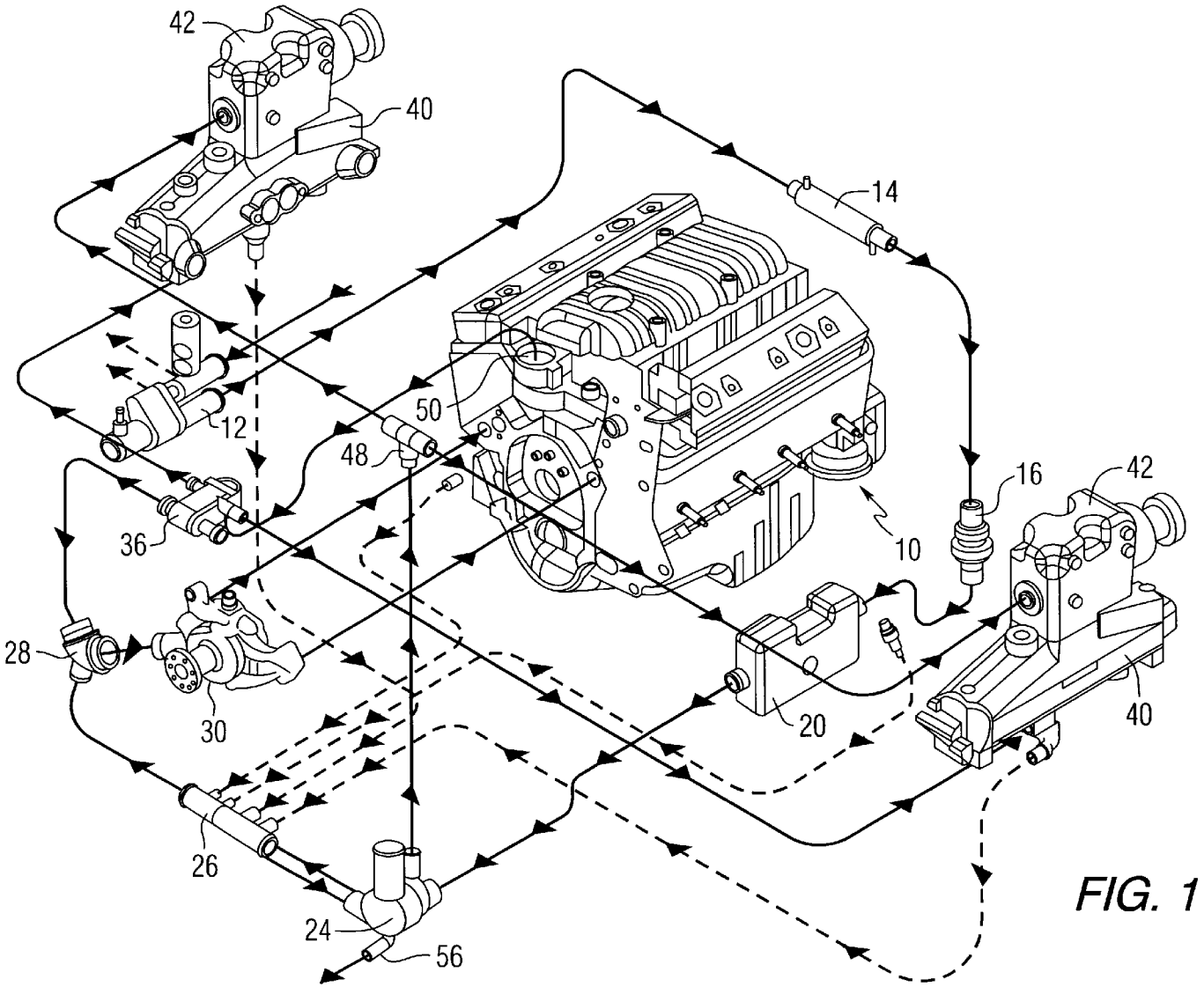
FIG. 1 is an exploded view of a marine propulsion engine cooling system.

Throughout the description of the preferred embodiment, like components will be identified by like reference numerals.

FIG. 1 shows an exploded view of an engine with its water cooling system in combination with arrows to show the direction of water flow during both the normal operation of the marine propulsion system and during draining procedures. Water is initially drawn by a sea pump 12 which, in certain marine propulsion systems, is part of a combined sea pump/drain actuator component as illustrated in FIG. 1. The marine propulsion system shown in FIG. 1 also comprises a power steering cooler 14 and a check valve 16, such as the siphon inhibiting device described above. Reference numeral 20 identifies a water cooled fuel module that is used to decrease the temperature of fuel passing to the engine 10. A distribution housing 24 is located at a low point in the water circuit in order to facilitate draining. The distribution housing 224 operates in a manner similar to that described in U.S. Pat. No. 6,135,064. A four-way fitting 26 is connected between the distribution housing 24 and a three-way fitting 28. The three-way fitting 28 is connected to the circulation pump 30 and to a thermostat housing 36.

Also shown in FIG. 1 are the port and starboard exhaust manifolds 40 along with their associated exhaust elbows 42. Another three-way fitting 48 is connected between the exhaust elbows 32 and the distribution housing 24.

In FIG. 1, the water circulation path used during normal operation of the engine is identified by solid line arrows while the water circulation path used during a draining procedure is identified by dashed line arrows. With reference to the thermostat housing 36, it should be noted that it is attached to the engine 10 at a location identified by reference numeral 50 in order for it to be efficiently connected in fluid communication with the cooling passages formed within the engine and cylinder heads. This type of connection is well known to those skilled in the art. Although the engine 10 is not sectioned in FIG. 1, those skilled in the art are well aware of the type of internal cooling passages contained therein. Water enters in parallel paths from the circulation pump 30, as shown, and exits into the thermostat housing 36, and overboard through the exhaust manifold and elbows 40 and 42.

Within the thermostat housing 36 is a thermostat that regulates the specific directions of the water flow within the engine block as a function of the water temperature. It should also be noted that the thermostat housing 36 is placed at a location 50 of the engine 10 that places the thermostat housing 36 above most of the internal cooling passages of the engine 10. In many applications, this placement of the thermostat housing 36 locates the thermostat housing above all other portions of the engine cooling system.

With continued reference to FIG. 1, it should be understood that when the engine is drained, water flows from several sources within the cooling system of the engine and to the distribution housing 24 and sea pump 12 and then out of the drain conduits 56. If the improvements provided by several of the drain systems described above are implemented, this draining process is performed much more quickly than previously when the draining process required significant manual intervention in the removal of various drain plugs. This rapid draining of the cooling water can form air pockets within the cooling system which experience significantly decreased pressure. This decreased pressure can draw water from unintended sources, such as the exhaust system which is in fluid communication with the body of water in which the marine propulsion system is operated.

Figure 2:
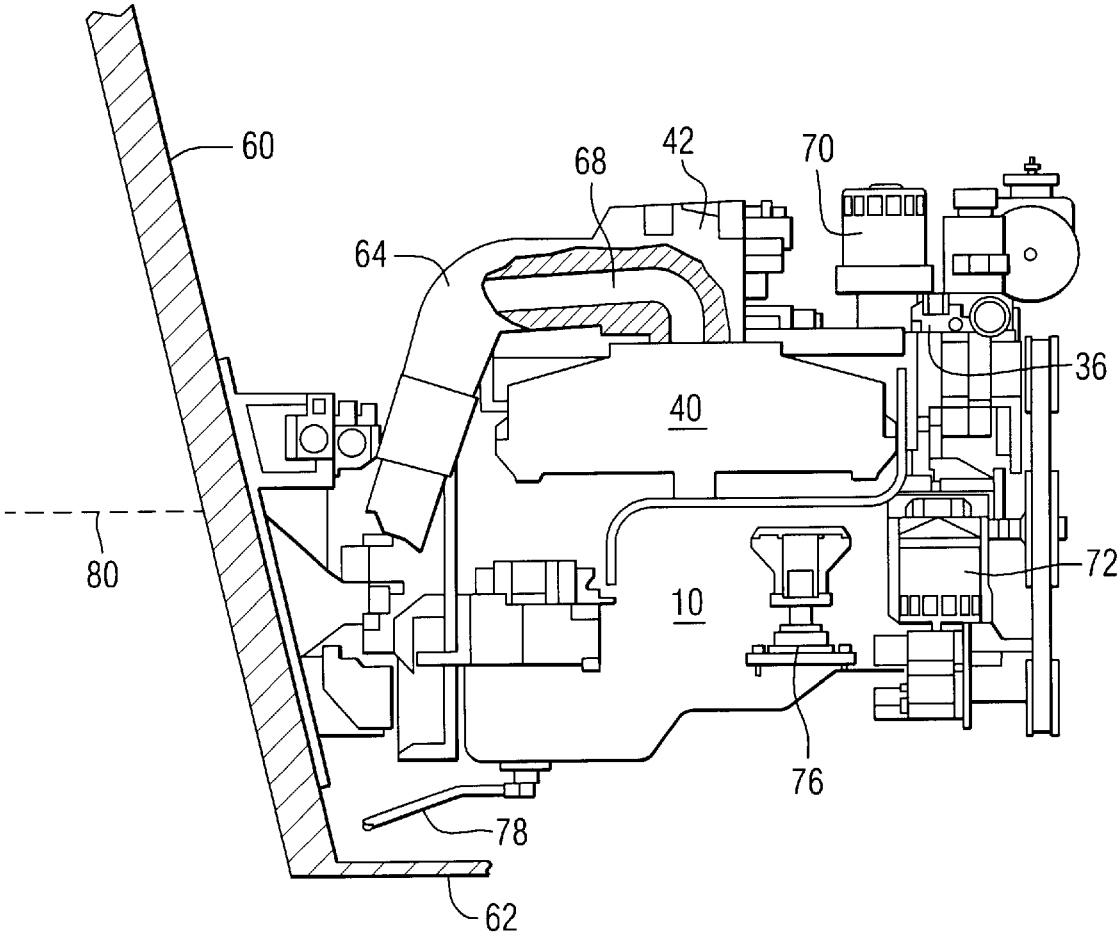
FIG. 2 is a side view of a marine propulsion system, showing the relative positions of components of the marine propulsion system and the level of the body of water in which the system is operated.

FIG. 2 is a schematic representation of a marine propulsion system illustrated for the purpose of showing the relative positions of the components described above in conjunction with FIG. 1. The engine 10 is located at a position forward of the transom 60 and above the bottom surface 62 of the boat. A portion of an exhaust conduit 64 and the exhaust elbow 42 are sectioned to show the internal exhaust passage 68. In a manner well known to those skilled in the art, the exhaust conduit 64 extends through the transom 60 (not shown in FIG. 2) and in certain types of marine propulsion systems this exhaust conduit 64 is placed in fluid communication with the body of water in which the marine propulsion system operates. During normal operation, exhaust gases pass through the exhaust manifold 40, the exhaust elbow 42, and through the exhaust passage 68 to be discharged below the surface of the body of water. When the marine propulsion system is drained of its cooling water while the marine vessel is in the body of water, the low pressure described above can draw water, in a reverse direction, from the body of water, through the exhaust passage 68, and into the exhaust manifold 40. This is a potentially damaging condition and should be avoided.

With continued reference to FIG. 2, an optional oil filter 70 and a fuel filter 72 are shown to illustrate the relative locations of these elements. In addition, an engine support bracket 76 and an oil drain hose 78 are also illustrated. At the forward and upper portion of the marine propulsion system, the thermostat housing 36 is attached to the engine 10. As can be seen, the thermostat housing 36 is located at a position that is above most, if not all, of the internal cooling passages within the engine 10. For purposes of reference, the water level 80 is illustrated to show the relative positions of the components of the marine propulsion system and the surface of the body of water in which the marine propulsion system is operated.

With reference to FIGS. 1 and 2, there are two situations in which air must either be expelled from the engine 10 or allowed into the engine 10. With regard to the requirement for expelling air from the cooling system of the engine 10, the cooling system is full of air anytime after the water has been drained from the conduits of the cooling system. For example, this occurs after the operator has used one of the water drain systems described above or after the engine has been serviced. Also, this situation occurs following the removal of the boat from storage. During the initial engine starting operation, air within the cooling system must be replaced by water. If the air is not replaced within a reasonable period of time, "vapor lock" occurs and the water flow through the cooling system stagnates. This causes the engine to overheat and typically results in an engine protection system providing an alarm. If pockets of air are allowed to remain in the cooling system during the initiation of operation under the conditions described above, this overheating condition can result.

Under certain conditions, air must be allowed into the cooling system of the engine. For example, when the cooling system of the marine propulsion engine is being drained while it is resting on the water, through the use of any one of the drain systems described above, the water leaving the cooling system must be replaced by air to avoid significant decreases in pressure within the cooling system conduit. This is particularly important in marine propulsion systems that expel exhaust below the water line 80 of the marine vessel. If low pressure regions in the cooling system are allowed to form, as a result of the rapidly evacuating water, the low pressure within the cooling system can draw water, from the body of water, through the exhaust passage 68 and into the exhaust manifold 40. In other words, the water that is rapidly evacuated from the cooling system forms low pressure regions in pockets of air within the cooling system and this reduced pressure is sufficient, under certain circumstances, to cause water to rise from the body of water through the exhaust passage 68 as a result of the siphon effect caused by the low pressure. Both of these conditions, wherein air must flow into the cooling system or be expelled from the cooling system, must be addressed in any marine propulsion system.

Figure 3A:
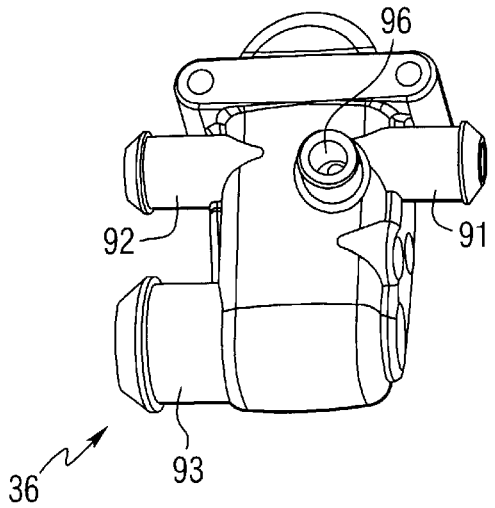
FIGS. 3A and 3B show two isometric views of a thermostat housing used in conjunction with the present invention.
Figure 3B:
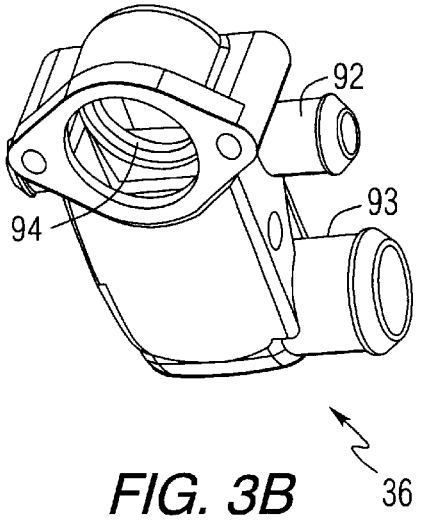

FIGS. 3A and 3B show two isometric views of the thermostat housing 36. Outlets 91 and 92 are connectable in fluid communication with the exhaust manifolds 40, as illustrated schematically in FIG. 1. Outlet 93 is connectable to the three way fitting 28 shown in FIG. 1. Although not shown in the figures, a thermostat is received in the region identified by reference numeral 94 to regulate flow through the cooling system as a function of the temperature of the cooling system.

In FIG. 3A, a port 96 is shown formed in thermostat housing 36. This port is related to a membrane of the present invention which passively allows air to flow into or out of the cooling system as a function of differential pressure between one side of the membrane and the other side.

Figure 4:
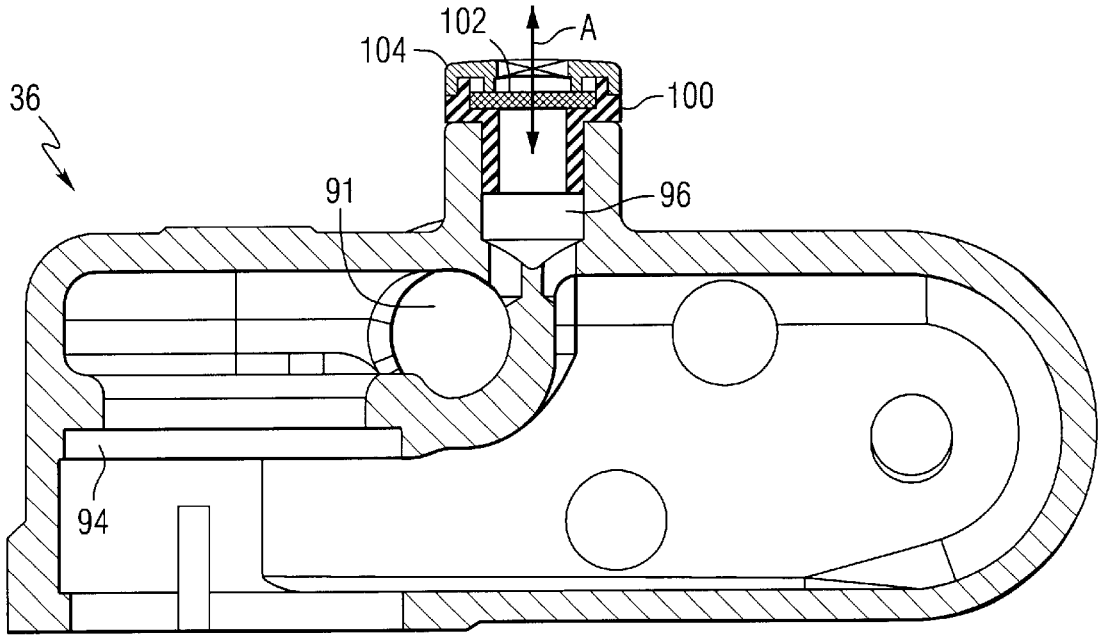
FIG. 4 is a section view of a thermostat housing used in conjunction with the present invention.

FIG. 4 is a section view of a thermostat housing 36 showing the conduit 91, the region 94, and the port 96. With reference to FIGS. 1, 2, and 4, it can be seen that the port 96 is located at a position at or near the highest point of the cooling system when the thermostat housing 36 is attached to location 50 of the engine 10.

In FIG. 4, a port 96 is associated with an insert 100 that is shaped to receive and hold a hydrophobic or oleophobic membrane 102. A cap 104 is attached to the insert 100 to hold the membrane 102 in position and provide support for it. Arrow A represents the passage of air through the membrane 102. As can be seen, air can pass in either direction through the membrane 102, depending on the relative pressures above and below the membrane 102. A hydrophobic membrane 102 is permeable to gas, such as air, but impermeable to liquid, such as water. Some hydrophobic membranes are also oleophobic. A hydrophobic membrane repels water and, to a predetermined degree, can not be wetted by aqueous solutions or by liquids with high surface tensions without first being wetted with agents of low surface tension, such as alcohol, or subjected to high pressures. Hydrophobic filters are best suited for gas and solvent filtration and venting. Oleophobic membranes, in addition to being hydrophobic, have the capacity to repel high viscosity fluids such as oil and lubricants and low viscosity fluids such as alcohols. The hydrophobic membrane 102, in certain circumstances, can also be oleophobic. As a result, water within the thermostat housing 36 is not permitted to pass through the membrane 102, but air is allowed to move through it as a function of the relative pressures on the upper and lower sides of the membrane 102.

With reference to FIGS. 1, 2, and 4, the oleophobic membrane 102 allows air to pass downward through the membrane and into the thermostat housing 36 when the cooling system of the marine engine 10 is being drained. As water is evacuated from the cooling system, in a generally downward direction, low pressure is naturally formed at the upper regions of the cooling system within the cooling passages of the engine and associated fluid conduits. This lower pressure, relative to ambient pressure above the membrane 102, causes air to pass downward through the membrane and fill the voids within the cooling system formed by the evacuating water. This dissipates the low pressure within the cooling system. As a result of the absence of this low pressure creation, water will not be drawn upward through the exhaust system as described above in conjunction with FIG. 2.

When the engine 10 is initially started after being drained of its cooling water, the pressure within the cooling passages of the engine and within the cooling system is higher than the ambient pressure above the port 96. As a result of a higher pressure below the membrane 102 than above the membrane, air passes upward through the membrane 102 and escapes from the cooling system. This escaping air is replaced by water being pumped by the sea pump 12 described above in conjunction with FIG. 1.

As described above, a preferred embodiment of the present invention places the oleophobic membrane 102 at a port 96 of the thermostat housing 36. However, it should be understood that the port 96 could be formed at any other part of the cooling system, as long as it is positioned at a location to allow air to advantageously enter the cooling system or be expelled from the cooling system for the reasons described above. In the preferred embodiment of the present invention, it was determined that a most convenient location for the port 96 was on the thermostat housing 36.

As described above, a marine propulsion system made in accordance with the present invention, comprises an engine 10 having cooling passages disposed in thermal communication with heat producing elements of the engine. Typically, these cooling passages are formed as cavities within the engine block and within associated portions of the engine, such as the heads, exhaust manifolds, and exhaust elbows. The present invention further comprises a fluid conduit which typically includes numerous cooling hoses and associated components, such as fluid coolers 20, power steering coolers 14, circulation pumps 30, sea pumps 12, and thermostat housings 36. FIG. 1 illustrates the interconnections between these various elements of the fluid conduit which is connected in fluid communication with the cooling passage of the engine 10. A port 96 is formed at a preselected location of the fluid conduit and a membrane 102 is used to cover the port. The membrane 102 is generally impermeable to a liquid, such as water, but generally permeable to a gas, such as air. A pump 12 is connected in fluid communication with the fluid conduit for drawing water from a body of water in which the marine propulsion system is operating and pumping the water through the fluid conduit to the cooling passages of the engine. The thermostat housing 36, in a preferred embodiment of the present invention, is attached to a top portion 50 of the engine 10 with the port 96 located proximate a highest point of the fluid conduit. The port 96 is located proximate a point which is above the cooling passage of the engine. The membrane 102 is hydrophobic and, in a preferred embodiment, is also oleophobic. The port 96 is formed as a portion of the outer surface of the thermostat housing 36.

Although the present invention has been described in particular detail and illustrated with specific reference to a preferred embodiment, it should be understood that alternative embodiments are also within its scope.

We claim:

1. A marine propulsion system, comprising:

an engine having a cooling passage;

a fluid conduit connected in fluid communication with said cooling passage, said fluid conduit comprising a thermostat housing;

a port formed at a preselected location of said fluid conduit, said port being formed in said thermostat housing; and a membrane covering said port, said membrane being generally impermeable to liquid and generally permeable to gas.

2. The propulsion system of claim 1, further comprising:

a pump connected in fluid communication with said fluid conduit for drawing water from a body of water in which said marine propulsion system is operated and pumping said water through said fluid conduit to said cooling passage of said engine.

3. The marine propulsion system of claim 1, wherein:

said thermostat housing is attached to a top portion of said engine.

4. The propulsion system of claim 1, wherein:

said port is located proximate a highest point of said fluid conduit.

5. The propulsion system of claim 1, wherein:

said port is located proximate a point which is above said cooling passage of said engine.

6. The propulsion system of claim 1, wherein:

said membrane is hydrophobic.

7. The propulsion system of claim 1, wherein:

said membrane is oleophobic.

8. The propulsion system of claim 1, wherein:

said cooling passage of said engine comprises a cavity formed in a block of said engine to provide a path for cooling water to pass in thermal communication with heat producing components of said engine.

9. A marine propulsion system, comprising:

an engine having a cooling passage formed within a block of said engine;

a fluid conduit connected in fluid communication with said cooling passage, said fluid conduit comprising a thermostat housing, a port formed at a preselected location of said fluid conduit, said port being formed in said thermostat housing; and a hydrophobic membrane covering said port, said membrane being generally impermeable to liquid and generally permeable to gas.

10. The propulsion system of claim 9, further comprising:

a pump connected in fluid communication with said fluid conduit for drawing water from a body of water in which said marine propulsion system is operated and pumping said water through said fluid conduit.

11. The marine propulsion system of claim 9, wherein:

said thermostat housing is attached to a top portion of said engine.

12. The propulsion system of claim 9, wherein:

said port is located proximate a point which is above said cooling passage of said engine.

13. The propulsion system of claim 12, wherein:

said port is located proximate a highest point of said fluid conduit.

14. The propulsion system of claim 9, wherein:

said membrane is oleophobic.

15. A marine propulsion system, comprising:

an engine having a cooling passage formed within a block of said engine;

a fluid conduit connected in fluid communication with said cooling passage, said fluid conduit comprising a thermostat housing;

a port formed at a preselected location of said fluid conduit, said port being formed in said thermostat housing;

a hydrophobic membrane covering said port, said membrane being generally impermeable to liquid and generally permeable to gas.

16. The propulsion system of claim 15, further comprising:

a pump connected in fluid communication with said fluid conduit for drawing water from a body of water in which said marine propulsion system is operated and pumping said water through said fluid conduit.

17. The propulsion system of claim 16, wherein:

said port is located proximate a point which is above said cooling passage of said engine.

18. The propulsion system of claim 17, wherein:

said port is located proximate a highest point of said fluid conduit and said membrane is oleophobic.

* * * * *